US005566684A

United States Patent [19]

Wagner

[11] Patent Number: 5,566,684

[45] Date of Patent: Oct. 22, 1996

[54] CUSTOM FIT MOUTHGUARD

[75] Inventor: Eugene C. Wagner, Pacific Palisades, Calif.

[73] Assignee: Dental Concepts Inc., Elmsford, N.Y.

[21] Appl. No.: 560,278

[22] Filed: Nov. 21, 1995

[51] Int. Cl.[6] ..... A61C 5/14

[52] U.S. Cl. ..... 128/861; 128/862

[58] Field of Search ..... 128/859–862, 128/848; 2/2

[56] References Cited

U.S. PATENT DOCUMENTS

| | | | |
|---|---|---|---|
| 2,521,039 | 9/1950 | Carpenter | 128/136 |
| 3,124,129 | 3/1964 | Grossberg | 128/862 |
| 3,224,441 | 12/1965 | Monaghan | 128/136 |
| 3,236,235 | 2/1966 | Jacobs | 128/862 |
| 3,411,501 | 11/1968 | Greenberg | 128/136 |
| 3,457,916 | 7/1969 | Wolicki | 128/136 |
| 3,485,242 | 12/1969 | Greenberg | 128/136 |
| 3,527,219 | 9/1970 | Greenberg | 128/861 |
| 3,692,025 | 9/1972 | Greenberg | 128/136 |
| 3,864,832 | 2/1975 | Carlson | 128/862 |
| 4,044,762 | 8/1977 | Jacobs | 128/136 |
| 4,114,614 | 9/1978 | Kesling | 128/136 |
| 4,350,154 | 9/1982 | Feldbau | 128/861 |
| 4,848,365 | 7/1989 | Guarlotti et al. | 128/859 |
| 5,082,007 | 1/1992 | Adell | 128/861 |
| 5,152,301 | 10/1992 | Kittelsen et al. | 128/861 |
| 5,234,005 | 8/1993 | Kittelsen et al. | 128/859 |
| 5,277,203 | 1/1994 | Hays | 128/861 |
| 5,339,832 | 8/1994 | Kittelsen et al. | 128/862 |
| 5,406,963 | 4/1995 | Adell | 128/861 |
| 5,503,552 | 4/1996 | Diesso | 433/37 |
| 5,511,562 | 4/1996 | Hancock . | |

*Primary Examiner*—Michael A. Brown
*Attorney, Agent, or Firm*—Natter & Natter

[57] ABSTRACT

A molded mouthguard is shaped in the configuration of a maxillary arch. The mouthguard includes a trough which is channel shaped in transverse cross section and a moldable upper fill which extends higher than the channel at least at the front, rear and buccal walls of the trough. The fill comprises a low softening temperature thermoplastic such as a suitable EVA and the trough is formed of a higher softening temperature thermoplastic. The mouthguard is suitable for do-it-yourself custom molding and is heated by emersion in water to a glass transition temperature which is below boiling temperature, e.g. within a range of 140° F. to 180° F., for approximately two minutes. The mouthguard is then inserted into the mouth, and centered against the teeth of the maxillary arch. The user then bites, causing the fill to extrude over the labial and buccal front, sides and rear of the trough as the fill conforms to the impression of the upper teeth. The extruded fill is forced against the gums and pallet for added protection and retention of the mouthguard.

10 Claims, 2 Drawing Sheets

CUSTOM FIT MOUTHGUARD

BACKGROUND OF THE INVENTION

1. Field of the Invention

This invention relates generally to safety devices, particularly to devices for reducing or preventing the severity or occurrence of head injuries and more specifically to a mouthguard suitable for do-it-yourself custom fitting.

2. Background History

Mouthguards were first introduced in the 1920's for use in the sport of boxing. Such early mouthguards were formed of pieces of rubber cut to the shape of the maxillary arch and held in place by clenching the teeth together. Since the teeth were required to be clenched to maintain the mouthguard in position, it was difficult if not impossible to achieve oral air flow which was crucial for the purpose of increasing levels of oxygen intake required during physical exertion. Additionally, because the early mouthguards were loose fitting and easily displaced by impact force, there was a significant risk of being dislodged, causing airway obstruction. This proved to be particularly hazardous in the sport of boxing, where there was a likelihood of a participant being rendered unconscious.

A typical improvement in the early rubber mouthguards was illustrated in the patent to CARTHETER, U.S. Pat. No. 2,521,039 which disclosed a rubber mouthguard having a central airway passage. Such mouthguards also interfered with speech since they were kept in place only by biting the teeth together.

Attempts at improving rubber mouthguards led to the introduction of thermoplastics including mouth-formed mouthguards which were immersed in boiling water and then formed in the mouth by using biting pressure. In order to provide effective protection, such mouthguards were required to be centered properly over the dental arch and cover all posterior teeth.

These mouthguards suffered from several disadvantages, including lack of proper extension into the buccal vestibules and to the distal molars. Additionally, athletes were prone to cut the posterior region of such mouthguards because the mouthguards were generally bulky and did not fit well. Shortening the mouthguards, however, resulted in increased chance of injury.

Custom formed mouthguards have been prepared by dentists for their patients. Such mouthguards were molded from casts of the patient's mouth taken after a dental impression had been made. While these mouthguards overcame many of the disadvantages of prior mouthguards such as retention problems, comfort, and interference with speaking and breathing, the procedure for making the mouthguards was time consuming and considerable expense was involved in both material costs and professional fees.

The Applicant herein appreciated that there is a present need for a mouthguard having the benefits of a dentist fitted custom made mouthguard at a lower cost and without the requirement to engage the services of a dental professional.

SUMMARY OF THE INVENTION

A do-it-yourself custom fit mouthguard includes a thermoplastic channel trough in the configuration of a maxillary arch. Molded to the trough is a low melt temperature deformable thermoplastic upper fill. The fill extends to elevations higher than the walls of the channel trough at at least the front and rear of the trough. Among the suitable fill materials are low melt temperature EVA thermoplastics. Preferably, the fill material softens sufficiently for deformation to receive the impression of teeth after being immersed in water at a temperature range of approximately 140° F. to 180° F. for approximately two minutes to attain the glass transition temperature.

The trough is formed of a higher melt temperature thermoplastic and may comprise an EVA such as Elvax 250 or Elvax 260 which is injection molded at a mold temperature of approximately 350° F. whereas the upper fill is injection molded into a mold having the trough as a core at temperature ranges between 185° to 250° F. Preferably, the upper fill is melt bonded to the trough.

The mouthguard is custom molded to conform to the mouth of the user after being heated by being immersed in hot water, then inserted into the mouth and placed against the teeth of the maxillary arch. The jaw is then closed and the user bites against the mouthguard, forcing the upper teeth into the fill and causing the fill to extrude over the walls of the trough.

The extruded fill material is then urged against the pallet, the rear teeth, the gingival surfaces of buccal vestibules and the gingival surfaces of the labial vestibule to conform with the contours of the mouth affording a great degree of shock protection as well as assuring retention by eliminating air gaps between the fill material and the oral surfaces.

From the foregoing compendium, it will be appreciated that it is an aspect of the present invention to provide a mouthguard of the general character described which is not subject to the disadvantages of the background history aforementioned.

A consideration of the present invention is to provide a mouthguard of the general character described which is custom fit without the necessity of employing the services of a dental professional.

A feature of the present invention is to provide a mouthguard of the general character described which is easy to use and relatively low in cost.

Another aspect of the present invention is to provide a mouthguard of the general character described which provides the advantages of a custom made mouthguard without the costs generally associated therewith.

A further feature of the present invention is to provide a mouthguard of the general character described which reduces the severity of injuries such as coronal fractures, radicular fractures, corpus fractures of the mandible and concussions.

Another consideration of the present invention is to provide a mouthguard of the general character described which reduces the severity or prevents the occurrence of injuries such as tissue lacerations of the gingiva, oral condyles and gonial angles.

Another feature of the present invention is to provide a mouthguard of the general character described which does not appreciably inhibit the user's ability to speak.

To provide a mouthguard of the general character described which facilitates free oral breathing is yet a further consideration of the present invention.

It is another aspect of the present invention to provide a mouthguard of the general character described which is custom fit to the user's mouth after being heated to a glass transition temperature as low as 140° F.

To provide a mouthguard of the general character described which is pliable, yet sufficiently resilient to be bite and tear resistent is a still further feature of the present invention.

A further aspect of the present invention is to provide a mouthguard of the general character described which disseminates impact force on a wide area for shock attenuation without injury.

Other aspects, features and considerations of the present invention in part will be obvious and in part will be pointed out hereinafter.

With these ends in view, the invention finds embodiment in the various combinations of elements, arrangements of parts and series of steps by which the said aspects, features and considerations aforementioned and certain other aspects, features and considerations are attained, all with reference to the following description and drawings and the scope of which will be more particularly pointed out and indicated in the appended claims.

BRIEF DESCRIPTION OF THE DRAWINGS

In the accompanying drawings in which are shown some of the various possible exemplary embodiments of the invention.

DESCRIPTION OF THE PREFERRED EMBODIMENT

Figure 4:
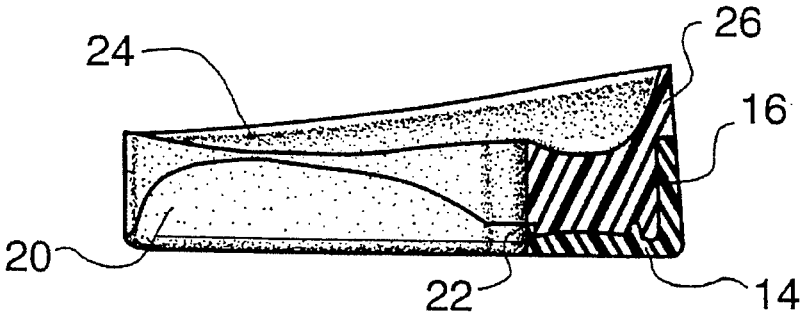
FIG. 4 is a sectional view thereof, the same being taken substantially along the plane 4—4 of FIG. 2 and more clearly showing the upper contour of the fill.

Referring now in detail to the drawings, the reference numeral 10 denotes generally a custom fit mouthguard constructed in accordance with and embodying the invention. The mouthguard 10 includes a lower trough 12 of channel shaped cross section, as indicated in FIG. 4. Accordingly, the trough 12 is formed with a generally planar bottom wall 14, a labial front wall 16 and buccal side walls 18.

Figure 1:
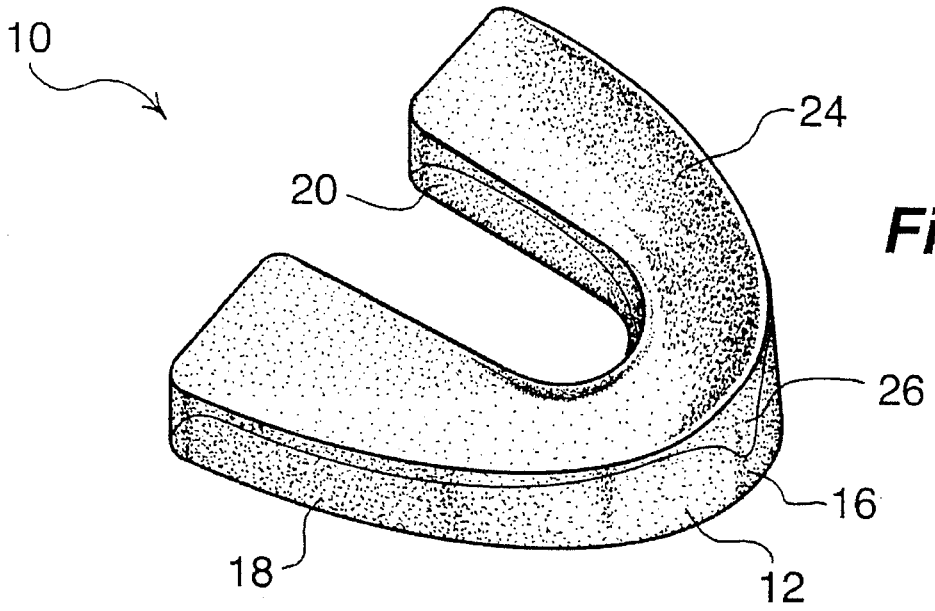
FIG. 1 is a perspective illustration of a custom fit mouthguard constructed in accordance with and embodying the invention and showing a lower trough and an upper fill.

As will be noted from an examination of FIG. 1, the overall plan configuration of the trough 12 is that of a maxillary arch, i.e. generally "U" shaped. The trough 12 includes a pair of lingual side walls 20 and a reduced height pallet front wall 22.

The trough 12 may be injection molded of a suitable thermoplastic with a mold temperature in the order of 350° F. Suitable thermoplastics for employment include EVA compositions such as Elvax 260 and Elvax 250.

Figure 2:
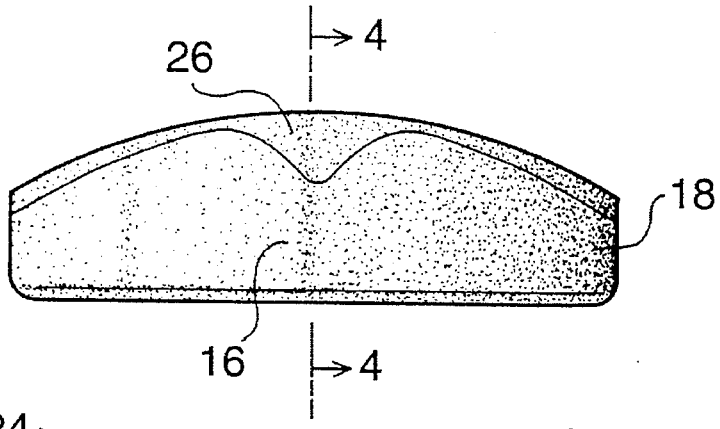
FIG. 2 is a front elevational view thereof.
Figure 3:
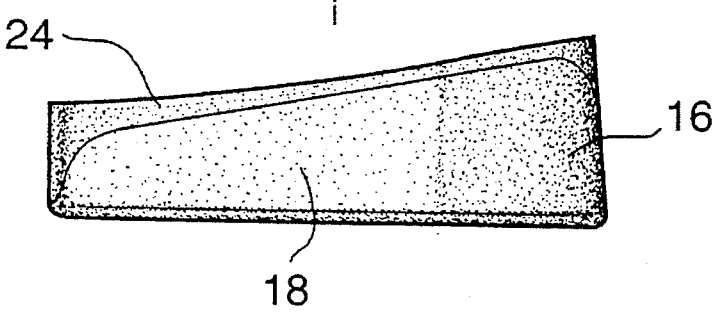
FIG. 3 is a left side elevational view thereof.

The mouthguard 10 also includes an upper fill 24 formed of lower softening temperature thermoplastic which is injection moldable at a lower temperature range, for example, 180° F. through 250° F. An EVA composition, such as Elvax 150 may be employed. The fill 24 is preferably injection molded to the trough 12 by first placing a completed trough into a mold. The upper surface of the fill 24 is preferably concavely contoured, as illustrated in FIGS. 1 and 4 and the fill 24 is molded with a labial front surface 26 which extends above the elevation of the labial wall 16 of the trough. Similarly, the elevation of the buccal wall of the fill extends above the elevation of the buccal side walls 18 of the trough, as illustrated in FIGS. 1, 2 and 3.

At the distal ends of the trough 12, the fill extends to an elevation substantially greater than that of the walls of the trough. The lingual front wall of the fill 24 extends to an elevation significantly greater than the pallet front wall 22 of the trough.

After being purchased by an ultimate user, the mouthguard 10 is particularly adapted to be custom fitted in a do-it-yourself procedure. The thermoplastic material of the upper fill 24 is selected to be softenable and retain the impression of teeth at temperatures well below those which would cause discomfort or burning within the oral cavity during a fitting procedure. Specifically, the EVA compositions from which the fill is selected are preferably softenable within a glass transition temperature range of as low as 140° and extending to approximately 185° to 190°.

A typical procedure for custom fitting the mouthguard 10 is to place boiling water in a mug or cup and then allow the water to cool to the desired temperature range, by waiting approximately five minutes. Thereafter, the mouthguard 10 is immersed into the water and remains for approximately two minutes during which time the mouthguard temperature is elevated to the desired range. Thereafter the mouthguard 10 is inserted into the mouth and registered with the maxillary arch.

The user then exerts a biting force, pressing the maxillary teeth into the upper fill 24 and causing the upper fill material to extrude over the walls of the trough.

The user then conforms the extruded fill to the surface of his or her pallet by utilizing the user's tongue to urge the material upwardly against the pallet. Such forming may be augmented by utilizing a thumb or finger to urge the fill material against the pallet.

The fill material which extends into the buccal vestibule is urged against the gums for protection of tooth roots and gingival surfaces with the user placing fingers against the outside of the gum and pushing inwardly. Similar force is applied to urge the cheeks inwardly to shape the extruded fill in the buccal vestibules and finally, fingers placed in the mouth may be employed to further conform the extruded fill material to oral cavity tissue.

Figure 5:
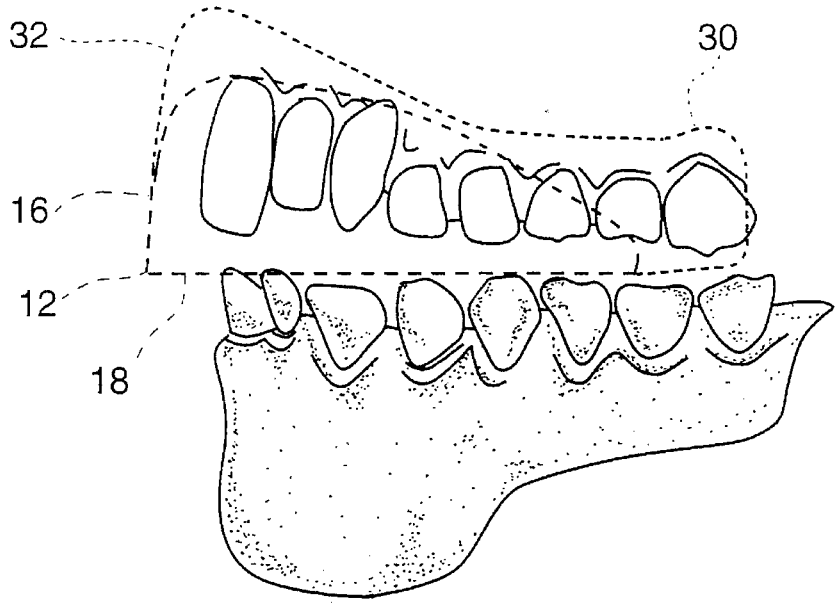
FIG. 5 is an enlarged auxiliary partial side elevational view of the jaws of a user after the mouthguard has been form fitted and showing the trough in dashed lines and the fill, extruded over the walls of the trough, in dotted lines.
Figure 6:
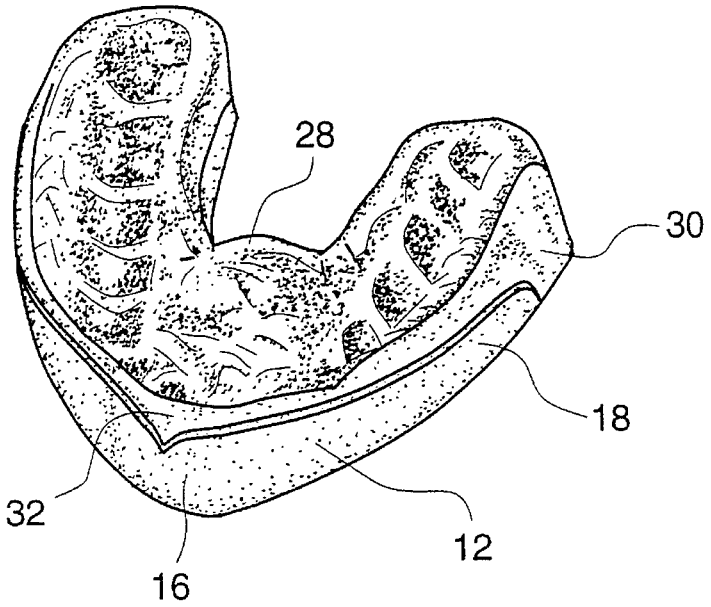
FIG. 6 is a perspective view of the mouthguard after it has been fitted to conform to the surfaces of a user's mouth.

A typical finalized configuration of the mouthguard is illustrated in FIGS. 5 and 6. FIG. 5 is an enlarged side elevation view of the user's jaw with the trough 12 shown in dashed lines and the extruded fill 24 shown in dotted lines. FIG. 6 is a perspective illustration showing fill material 28 shaped to conform to pallet surfaces, fill material 30, extruded above and beyond the ends of the trough, shaped to conform and protect molars and wisdom teeth and fill material 32, extruded over the labial front wall of the trough and configured to conform to and protect gingival surfaces above the front teeth and the tooth roots.

It should also be noted that the thermoplastic material of the trough 12 will have sufficiently softened, as a result of the placement of the mouthguard in the hot water, to receive the impression of the upper surfaces of the teeth of the mandibular arch, as illustrated in FIG. 5 and will thus serve to lock the lower jaw into position.

In sports mouthguard applications it is preferable for the fill 24 to be melt bonded to the trough 12 during the molding of the mouthguard 10. Such bonding is facilitated in part by utilizing EVA compositions for both the trough and fill. The invention also encompasses the utilization of different based thermoplastic compositions for the fill and for the trough.

For example, the fill 24 may comprise an EVA composition while the trough may be formed of a thermoplastic elastomer.

Under such circumstances and depending on temperatures of the injected materials, a melt bond may be less likely to occur. It may be desireable to strip the trough from the fill after the guard has been custom fitted in the user's mouth. This renders the guard particularly well suited for the treatment of brusixm, the typical grinding of teeth, usually nocturnal. Since such applications do not encounter shock forces, the necessity for a harder, more durable trough is not present and the maxillary teeth need not be forced into the fill as deeply as required for sports mouthguard applications.

Thus it will be seen that there is provided a custom fit mouthguard which is well suited to meet the conditions of practical usage and which achieves the various aspects, features and considerations of the present invention.

Since various possible embodiments might be made of the present invention and since various changes might be made in the exemplary embodiment set forth herein without departing from the spirit of the invention, it is to be understood that all matter herein described or shown in the accompanying drawings is to interpreted as illustrative and not in a limiting sense.

Having thus described the invention there is claimed as new and desired to be secured by Letters Patent:

1. A mouthguard suitable for custom fitting in a user's mouth and for conforming to the contours thereof, the mouthguard comprising a generally U-shaped thermoplastic trough, the trough being channel shaped in transversed cross section, the trough including a bottom wall, a labial front wall, a pallet front wall, the pallet front wall having a height less than the labial front wall, a pair of buccal side walls and a pair of lingual side walls, the mouthguard further including a thermoplastic fill, the fill being carried in the trough and extending above the elevation of the labial front wall, the pallet front wall and at least a front and a rear portion of the lingual side walls, the thermoplastic fill being formed of a composition having a glass transition temperature as low as 140° F., the trough being formed of a thermoplastic composition having a higher glass transition temperature.

2. A mouthguard suitable for custom fitting in a user's mouth as constructed in accordance with claim 1 wherein the trough is formed of an EVA thermoplastic composition.

3. A mouthguard suitable for custom fitting in a user's mouth as constructed in accordance with claim 2 wherein the EVA composition is selected from the group consisting of Elvax 250 and Elvax 260.

4. A mouthguard suitable for custom fitting in a user's mouth as constructed in accordance with claim 1 wherein the trough and the fill are melt bonded together.

5. A mouthguard suitable for custom fitting in a user's mouth as constructed in accordance with claim 1 wherein the trough is strippable from the fill after the fill has been fitted in the user's mouth.

6. A mouthguard suitable for custom fitting in a user's mouth as constructed in accordance with claim 5 wherein a thermoplastic fill comprises an EVA composition and the trough comprises a thermoplastic elastomer composition.

7. A mouthguard suitable for custom fitting in a user's mouth as constructed in accordance with claim 1 wherein the thermoplastic fill comprises an EVA composition.

8. A mouthguard suitable for custom fitting in a user's mouth as constructed in accordance with claim 1 wherein the fill includes an upper surface, the upper surface being concavely contoured.

9. A method of custom fitting a mouthguard constructed in accordance with claim i to conform to the contours of a user's mouth, the method comprising the steps of:

(a) heating the mouthguard to at least its glass transition temperature;

(b) placing the mouthguard in the user's mouth with the fill being juxtaposed against the user's maxillary teeth;

(c) forcing the mouthguard upwardly toward the maxillary teeth to cause the maxillary teeth to become imbedded in the fill and to cause excess fill to be extruded from the trough; and (d) causing the extruded fill to conform to the surfaces of the user's mouth adjacent the maxillary teeth while the fill is at or above its glass transition temperature.

10. A method of custom fitting a mouthguard in accordance with claim 9 wherein the step of heating the mouthguard includes the steps of boiling a quantity of water, allowing the water to cool, and placing the mouthguard in contact with the water for a fixed duration.

* * * * *